US006137965A

United States Patent [19]

Burgeios et al.

[11] Patent Number: 6,137,965

[45] Date of Patent: Oct. 24, 2000

[54] CONTAINER FOR DEVELOPING EQUIPMENT

[75] Inventors: Werner Burgeios, Zusmarshausen; Georg Daffner, Schwarzenbruck, both of Germany

[73] Assignee: GID GmbH, Augsburg, Germany

[21] Appl. No.: 09/218,044

[22] Filed: Dec. 22, 1998

[51] Int. Cl.[7] ..... G03D 3/06

[52] U.S. Cl. ..... 396/626; 396/630; 396/641; 222/464.1; 222/318

[58] Field of Search ..... 396/626, 628, 396/630, 636, 641, 624; 222/464.1, 211, 318

[56] References Cited

U.S. PATENT DOCUMENTS 4,227,818 10/1980 Gacki ..... 222/23
4,533,225 8/1985 Shiga ..... 396/626
4,634,252 1/1987 Jeremijevic ..... 396/626
4,734,728 3/1988 Muller ..... 396/641
5,148,208 9/1992 Klosterboer et al. ..... 396/626
5,638,994 6/1997 Libit et al. ..... 222/464.1
5,842,076 11/1998 Glover et al. ..... 396/626

*Primary Examiner*—Alan A. Mathews
*Attorney, Agent, or Firm*—Sterne, Kessler, Goldstein & Fox, P.L.L.C.

[57] ABSTRACT

The invention relates to a container 1 for receiving and distributing liquids, which are employed in the development of photographic images. The container 1 comprises a liquid duct 2, which extending from a point in the vicinity of the floor of the container, extends to a connection member 3, arranged in the top region of the container, for receiving a connection means.

8 Claims, 2 Drawing Sheets

CONTAINER FOR DEVELOPING EQUIPMENT

Figure 1:
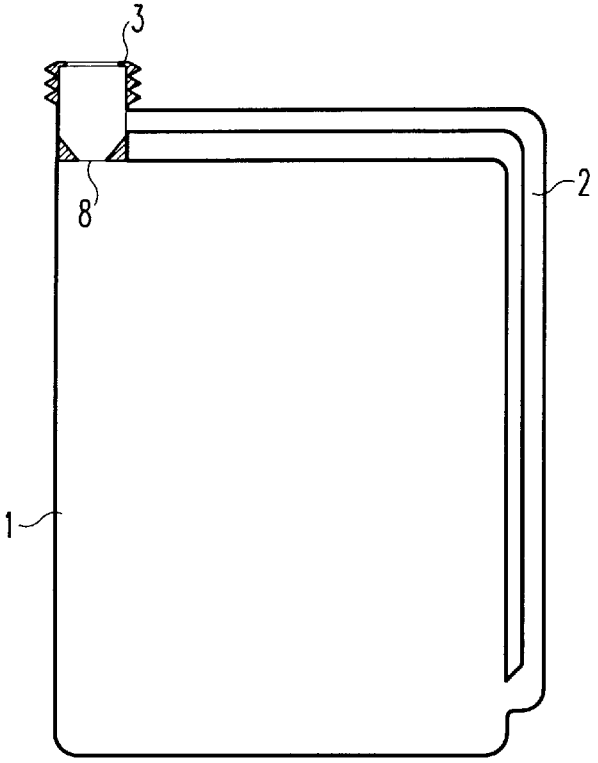

The invention relates to a container designed to receive and distribute liquids, which are employed in the development of photographic images. More especially, the invention relates to a container for receiving liquid employed in the course of photographic development, in the case of which a liquid duct extends from a point in the vicinity of the floor of the container to a connection member, arranged in the top region of the container, to receive a connection device.

BACKGROUND OF THE INVENTION

The development of photographic images is today performed in partially or even completely automatic equipment, in which the photographic material to be developed is run mechanically through the various baths arranged in the developing equipment and is if necessary subjected to a drying process at the end. As development equipment which is presently in widespread use it is possible to name COM recorders (computer output on microfilm), and furthermore x-ray film developing machines, processor cameras and dental development equipment.

The liquids employed in such processes, as for example the developing or fixing liquid, are consumed during operation by reaction of the chemicals with the material to be developed so that the chemical contained in the bath becomes exhausted in the course of time. In order to keep the developing action constant over a long period of time, the liquids in the baths are replenished from external containers in a manner dependent on the amount of the material to be processed to regenerate the liquid which has partly been expended. Since the bath of the respective liquid only has a limited volume, a volume of liquid must be removed equal to the supplied volume of liquid used for replenishment. This as a rule is performed by returning the liquid into the container.

The connection between the chemicals container and the processing baths is generally by way of loose hose hanging down into the baths, a pump device being provided in the supply means leading into the processing bath. A disadvantage of this arrangement is not only that there is a poor mixing of the returning liquid and the unused chemical present in the container, but also owing to the possibility of access of oxygen to the container there is also a high oxidation rate in the chemical contained in the container.

During the process of development the chemicals employed are frequently at high temperatures so that the liquids themselves must be heated. The heating of the liquids is generally so performed that the liquids are heated in the container or in the bath to an optimum temperature for processing and held there. One problem is in this respect that volatile components such as amines or amino alcohols are readily able to escape from heated liquids in open containers and may condense at various points within the equipment. Since the gases then escaping frequently develop a corrosive action, they may have a disadvantageous effect on the electrical control means of the development system, since the control elements, such as chips and other computer hardware present in the equipment are attacked by the gases.

A further problem occurring with replenishment from external containers is that the liquid is subject to oxidative degradation on contact with air, such degradation being even more pronounced when the liquid is heated in the container itself.

The U.S. Pat. No. 5,148,208 discloses a container for a photographic developing liquid, in the case of which the liquid in the container is heated from the outside through the surface of the container. The heat supplied to the container is controlled with the aid of a device for measuring temperature, which is also in contact with the wall of the container.

During the replacement of the storage container for replenishing the chemicals there is furthermore the danger of chemicals being spilled from or dripping out of the processing baths. Since the chemicals employed in the course of developing operations are hazardous to health, they constitute a potential danger for the operator of the equipment. By the same token it is difficult and in most cases impossible, to clean things such as a clothing or parts of the floor in the vicinity of the development equipment, once same have been soiled with developing liquid.

One object of the present invention is consequently to provide a container for receiving and distributing of a liquid employed for the development of photographic images, with which oxidative degradation of the liquid itself may be reduced to a minimum. Furthermore, the length of life of the chemicals used is to be prolonged.

A further object of the invention is to make available a container, with which contamination of the environment may be substantially prevented on changing the containers of the development equipment.

DESCRIPTION OF THE INVENTION

These objects are to the achieved by a container for receiving and distributing a liquid employed for photographic development, in the case of which a liquid duct extending from a point in the vicinity of the floor of the container extends to a connection member for receiving a connection device, said connection member being arranged in the top region of the container and being connected with the container.

In accordance with a preferred embodiment of the invention the connection member is arranged on the wall which is opposite to the floor of the container. Furthermore, it is possible for the connection member to be divided up by a partition means into a suction intake region and a return flow region, the suction intake region being joined with the liquid duct for the conduction of the liquid.

The connection member and the liquid duct are preferably made integrally with the container.

The invention will now be described in detail with reference to the drawings.

FIG. 1 shows a container 1 in accordance with the invention having a liquid duct 2 leading to a connection member 3.

FIG. 1(*a*) shows a view from above of the container 1, a part of the liquid duct 2 and the connection member 3 being depicted.

Figure 2:
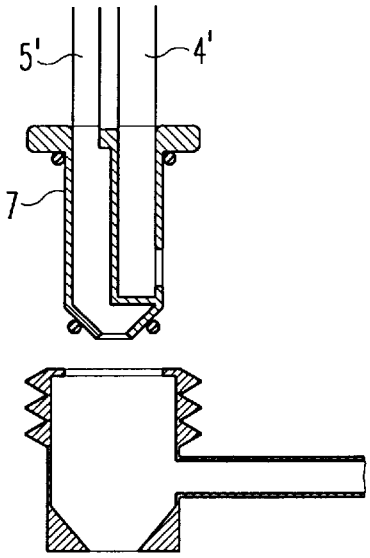
Figure 1A:
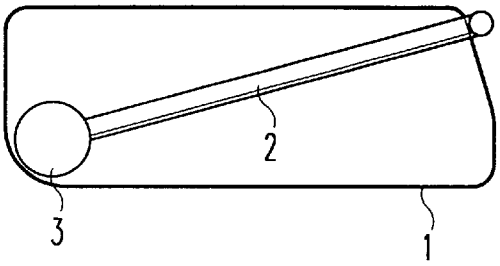

FIG. 2 shows an embodiment of the connection member 3, via which a suction/return means 7 for the liquid is arranged. This means 7 for removal and return of the liquid is divided up into a suction intake region 4' and a return region 5'.

Figure 2A:
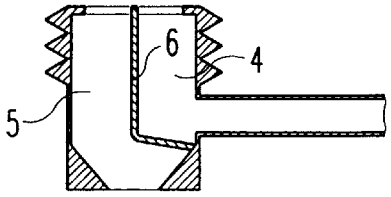

FIG. 2*a* further explains a preferred embodiment of the connection member 3, a partition being provided therein, which divides the connection member 3 into a suction intake region 4 and a return region 5.

Figure 3:
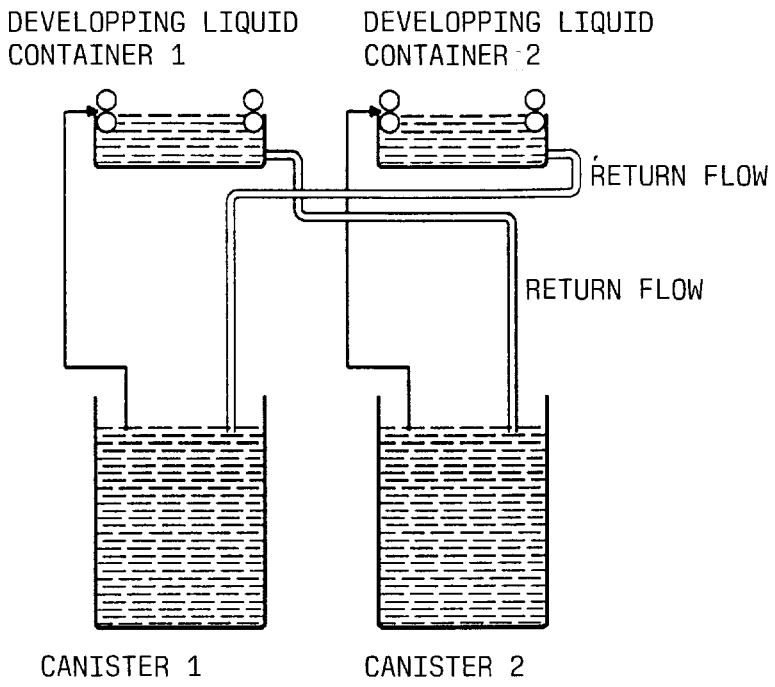

FIG. 3 diagrammatically shows one possibility for coupling two containers in accordance with the invention.

Figure 4:
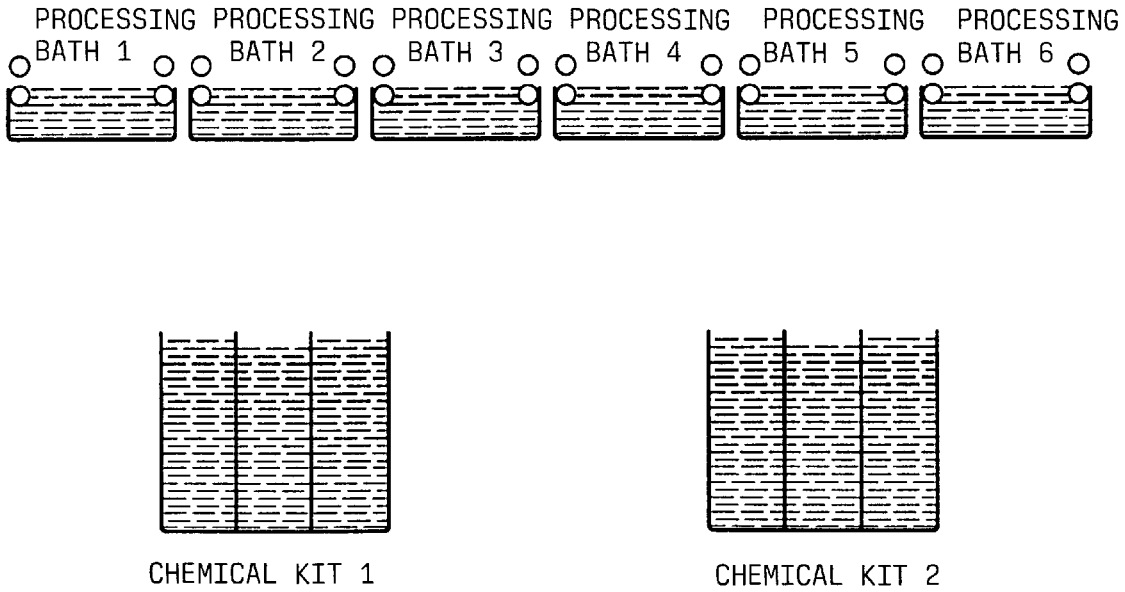

FIG. 4 diagrammatically shows an arrangement comprising six process containers, in the case of which the respective liquids are packaged together in two kits, each kit and having three containers for the baths 1 through 3 and, respectively, 4 through 6.

The invention will now be explained in detail with reference to a preferred embodiment thereof.

The container 1 for receiving a liquid possesses, in accordance with the usual design of such equipment, a floor and side walls. The container may have the form of a canister which walls extending in parallel to one another, i. e. there is a floor wall, side walls and a cover, or it may be in the form of a bell-like container tapering in an upward direction. In this case it is possible for the connection member 3 itself to represent the top region of the container. Other geometrical forms suitable for such containers are also possible, the only restriction being the features of the particular development equipment.

The container is customarily manufactured of plastic, more particularly polyethylene, polypropylene, PET of composite materials.

On one side wall of the container in the vicinity of the floor of the container a liquid duct 2 is arranged, via which the liquid in the bottom region of the container 1 may be sucked up and passed to a connection member 3 arranged in the top region of the container. The liquid duct 2 may be manufactured integrally with the container 1.

In a wall in a region thereof remote from the floor the container has an opening, in which a connection member 3 is installed for receiving a device for the removal of the liquid from the container. The connection member 3 is connected with the container in a sealed manner, as for example by means of a conventional fastening means, such as a screw thread or by clip means, or, in accordance with a preferred form of the invention, it may be manufactured integrally with the container 1. The connection member 3 possesses an opening in its one wall to receive the liquid duct, the opening being so spaced from the container that simple application of the liquid duct 2 to the connection member 3 is possible.

In accordance with a preferred embodiment the connection member 3 comprises a partitioning or separating means 6, which divides up the internal volume of the connection member 3 into a suction intake region 4 and a return flow region 5, a connection with the liquid duct 2 being provided because the duct opens into the suction intake region 4. In a similar manner partitioning into a suction intake region 4' and a return flow region 5' may also be provided in the device 7 for the removal of liquid. In this respect the device 7 is introduced into the connection member 3 and by suitable seals, for instance O-ring seals, connected in a sealing fashion with the connection member 3 itself or the container.

In accordance with a preferred embodiment the container 1 and furthermore the liquid duct 2 and the connection member 3 are manufactured in one piece. In this embodiment it is possible for the liquid duct to be so designed that same may simultaneously serve as a carrying handle so that handling the container is facilitated.

For use of the container in accordance with the invention it is an advantage for same to be supplied in a kit with a plurality of containers. Such a kit will generally comprise at least two containers, which contain a developing liquid and a fixing liquid. The containers are then bound together using conventional means such as metal bands, means possibly provide with handles, for receiving and holding the containers in place. Kits with more than two containers are also comprised within the scope of the present invention, the further containers containing activators, second developers, bleaching baths, clarifying baths or the like. For improvement of the keeping qualities of the developed material it is possible, in the case of equipment operating without washing, also to provide containers for residual thiosulfate neutralizer, rinsing solutions, stop baths, stabilizers and liquids for final baths. The number of containers collected together in a kit is only limited by the space requirements in the developing equipment.

It has turned out that such kits minimize the danger of incorrect connection together of the respective containers with the corresponding baths, the operation of the developing equipment being facilitated.

If containers are replaced after the respective liquid has become spent, there is a danger of products being spilled from or dripping out of the processing baths and coming into contact with the surroundings and possibly with the operator of the equipment. In the case of the containers 1 of the invention after removal of shipping closures applied to the container 1 itself the connection member 3, the containers 1 are connected manually or automatically with the device 7 for the removal of the liquid. In this respect the device 7 for the removal and return of the liquid a separation of the inlet and outlet is ensured, or such a separation is produced even in the connection member 3 itself. In this respect the removal device 7 is so introduced into the connection member 3 that the suction intake region 4' completely surrounds the wall region of the connection member 3, in which the opening for the liquid duct 2 is located, and contact with the return region 5' is thus prevented. In a case such that a partitioning means for separation of a suction intake region 4 from a return region 5 is already provided in the connection member 3, it is merely necessary for the respective connections to be produced with the corresponding supply and removal ducts to and from the processing bath.

The connection between the containers and the processing baths is in accordance with the invention performed using a device 7, connected in a sealing fashion with the connection member 3, for removal and return of the liquid. This means that further access of atmospheric oxygen to the chemicals container is prevented, something which increases the keeping properties and accordingly the degree of utilization of the liquids employed.

In the ducts leading to the processing baths a pump device is arranged, with which the liquid coming from the containers may be caused to circulate via the supply ducts, via the processing baths and via the removal ducts. In accordance with the invention in this case the liquid is drawn off via the liquid duct 2 in the vicinity of the floor of the container and is conveyed via the connection member 3 and the supply ducts to the processing baths. In the supply ducts it is possible to provide a device for heating or warming the liquid flowing therethrough, such device preferably comprising a heated loop of corrosion-resistant material. Furthermore it is possible to provide filters for suspended materials, active carbon filters or the like at a suitable point.

On return the liquid coming from the processing baths is passed into the return region 5 of the connection member 3 arranged on the canister and will run through the container's opening 8 into the container 1. Since liquid is drawn in near the floor of the container 1 and is returned again via the top region of the container, it is possible to ensure satisfactory mixing of the returned and stored liquid so that the chemical employed may ultimately be made full use of.

By the selection of a suitable structure of the processing system it is possible to have different residence times of the film material to be developed in the different baths. Thus it is possible for instance to double the development time by charging bath number 1 and also bath number 2 with the same developer solution. Since during chemical development physical and chemical processes occur which differ as regards time, the two developers do not change equally. This effect may be taken into amount if developers with a different composition are utilized, something which is however relatively complex. Using the containers of the invention it is now possible to change over the two developers so that the chemical change in both baths is the same. Such a structure is for instance depicted in FIG. 3. The bath number 1 is charged with developer solution from a first container, the return flow from bath number 1 being passed into the second container. The content of the second container is passed into bath number 2 and the return flow from this bath goes into container number 1. By having such a structure the there is ultimately a further increase in capacity.

After their contents have been used up the containers in accordance with the invention may be resealed with the shipping closures and disposed of. Owing to particular design of the connection member 3 it is possible to prevent spillage of chemicals and to prevent contact of the chemicals with the operator of the development equipment.

Furthermore the scope of the present invention also extends to a device, in which the chemicals are supplied in one direction from the container and/or the kit(s) with a plurality of containers the processing operation, there being no return to the containers. In such cases it is possible to use not only ready-to-use processing solution but also regenerating solutions (refilling solutions), rejuvenating solutions (refreshing solutions) and furthermore concentrates and partial concentrates of multiple component products.

What is claimed is:

1. A container for liquid employed in photographic developing work comprising:

a liquid duct integally manufactured with the container; and a connection member disposed at a top region of the container, for receiving a connection means, wherein said liquid duct extends outside of the container from a point in the vicinity of a floor of the container to said connection member, and wherein said connection member includes a suction intake portion for receiving fluid from said liquid duct and a return region for receiving fluid into the container.

2. The container as set forth in claim 1, wherein the connection member is disposed on a wall opposite to the floor of the container.

3. The container as set forth in claim 1, wherein an internal space in the connection member is divided by a partitioning means into said suction intake region and said return region.

4. The container as set forth in claim 1, wherein the connection member is manufactured integrally with the container.

5. The container as set forth in claim 1 for the supply of liquids employed in photographic developing processes.

6. The use of a container as set forth in claim 5, a plurality of containers being combined together in a kit.

7. The use of a container as set forth in claim 5, wherein at least two containers are used with at least two baths, wherein liquid from the first container is supplied to the first bath and liquid in the second container is supplied to the second bath, and wherein liquid returning from the first bath is returned to the second container and liquid returning from the second bath is returned to the first container.

8. The use of one or a plurality of containers as set forth in claim 1 in a computer output in microfilm (COM) system.

* * * * *

UNITED STATES PATENT AND TRADEMARK OFFICE

CERTIFICATE OF CORRECTION

PATENT NO. : 6,137,965

DATED : Oct. 24, 2000

INVENTORS : Bourgeois *et al.*

It is certified that an error appears in the above-identified patent and that said Letters Patent is hereby corrected as shown below.

On the Cover Page, in item [19], delete "Burgeios" and insert - -Bourgeois- - therefor.

On the Cover Page, in item [75], delete "Burgeios" and insert - -Bourgeois- - therefor.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*